United States Patent [19]

Jörss

[11] Patent Number: 4,460,432

[45] Date of Patent: Jul. 17, 1984

[54] BOTTLE TABLE FOR LABELING MACHINES

[76] Inventor: Norbert Jörss, Albr. Altdorfer Str. 4, D-8402 Neutraubling, Fed. Rep. of Germany

[21] Appl. No.: 412,161

[22] Filed: Aug. 27, 1982

[30] Foreign Application Priority Data

Sep. 2, 1981 [DE] Fed. Rep. of Germany ..... 3134661

[51] Int. Cl.[3] ..... B65C 9/02

[52] U.S. Cl. ..... 156/567; 156/566; 156/DIG. 12; 156/DIG. 25; 198/803

[58] Field of Search ..... 156/566, 567, 568, DIG. 25, 156/DIG. 12; 198/803

[56] References Cited

U.S. PATENT DOCUMENTS

| | | | |
|---|---|---|---|
| 1,004,141 | 9/1911 | Briggs | 156/567 |
| 2,641,297 | 6/1953 | Wilckens et al. | 156/567 |
| 3,347,369 | 10/1967 | Conlon | 198/803 |
| 4,306,926 | 12/1981 | Pfulb | 156/567 |
| 4,369,214 | 1/1983 | Pfulbihl | 156/568 |

*Primary Examiner*—Michael G. Wityshyn
*Attorney, Agent, or Firm*—Fred Wiviott

[57] ABSTRACT

A bottle table for a labeling machine is ring-shaped and has an annular surface for receiving bottles and transporting the same in sequence between the stations of a labeling apparatus. The bottle table is supported for rotation by means of a ring bearing and a ring gear is disposed on the table and is engaged by a pinion for rotating the table about a vertical axis. A centering head is mounted on vertically adjustable supports extending upwardly from the table and is rotatably supported by means of a ring bearing on a stationary support. An undercarriage which supports the ring bearings occupies less than the basal plane of a support table and the ring bearing is supported over a radial range of less than 180° between the table and the undercarriage with the remaining portions of the table being self-supporting.

8 Claims, 5 Drawing Figures

BOTTLE TABLE FOR LABELING MACHINES

Figure 1:
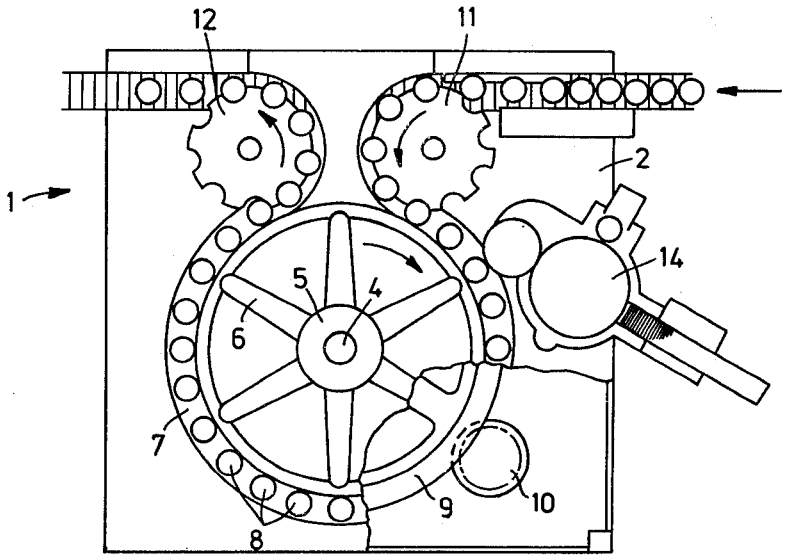
FIG. 1 PRIOR ART

The invention pertains to a rotating table with rotary plates controlled by cams for bottle labeling machines where the bottles to be labeled are transferred in sequence across a bottle guide system onto a ring shaped carrying surface of the bottle table. The bottle table is rotated relative to the carrying surface respectively the stations of labeling machine functions. The rotation is brought about by a drive system that meshes with the perimeter of the bottle table, whereby an undercarriage is mounted under the bottle table. The undercarriage accommodates those aggregates necessary for the bottle dressing as well as the bottle table.

Known bottle tables with a central axle show arms running from the central axle in star shape or radially outward. The extreme ends of the spokes are connected with the bottle ring which accepts the bottles to be transported and dressed. The conveyance of the bottles occurs in such a way, that the bottle table is set in rotary motion by means of a toothed drive at the perimeter of the table. The practice demands an increasingly higher machine performance and consequently bottle tables with ever larger diameters. This has as a result, that slight discrepancies in the center-axial suspension compound considerably at the perimeter of the bottle table and lead to tumbler movement of the bottle ring which is transmitted to the controlled rotary plates and the bottles on these. All such tumbler movement at the bottle ring must be eliminated to insure faultless operation of the labeling machine. To meet this problem the bottle table was formerly supported by a big and massive center bearing whereby a somewhat stabile and rigid configuration could be achieved. However, considering the star shaped arrangement of the bottle ring mounting, this led to a bulky, heavy and costly construction. The star-shaped mounting of the bottle ring with central-axial suspension has another disadvantage in that the bearing locations at the center axle are not easily accessible. Consequently repair, maintenance and cleaning in the area of the bottle table, especially removal of broken glass is considerably more difficult.

The task of the invention is the design of a considerably lightweight bottle table with rotary plates that can be manufactured at low cost and which at the same time insures greater stability and steadiness of the bearing while the inside area of the bottle table allows for free access.

In keeping with the invention, this is achieved thereby, that the bottle table with the rotary plates is designed as part of a rotary junction in the form of a ring bearing or is mounted on a similar rotary junction. The result is the support of the weight of the bottle table with bottles at the point where the load is, namely at the perimeter of the bottle table. In this fashion the achievement is that the bottle table, which is supported by the undercarriage, can be manufactured as a lightweight construction since the moments of flexure, affecting the stars formed by the arms, and the hub in the known configurations as well as the tumbler effects at the perimeter of the bottle table can not occur. Furthermore is warranted that the total inside area of the bottle table remains open, since there is no need for a central carrying hub with radial arms. Furthermore, in contrast with the known configuration, the drive of the bottle table can be arranged at the inner perimeter of the carrying ring, e.g. also in the form of a drive junction.

Furthermore, the proposition, in keeping with the invention, results in an undercarriage that can, in its horizontal expanse, be executed on a smaller scale than that of the conventional machines, since the suspension of the bottle table can occupy an area of less than 180° of the peripheral area of the bottle table, while a bottle table with a center axle requires in all cases an area of more than 180° of the peripheral area due to the central bearing.

Another rotary junction is provided on the centering head. The inner ring of the rotary junction is permanently connected with the centering head and rotates in synchronisation with the bottle table. The outer ring of the rotary junction, which is connected with the undercarriage by means of a holding rod, respectively support and consequently does not make any rotation, is developed to accommodate a lifting cam. The moving centering rods are lifted by this lifting cam in the areas of infeed and discharge. The stationary ring also serves to accept brush bodies of the brushing station.

As used in the case of this invention, the rotary junctions in the form of ring bearings or ring ball bearings or roller junctions are functionally so constructed, that the inner ring of the rotary junction is formed as bottle table, while the outer ring is mounted on the supports that rest on the undercarriage.

Here follows a clarification of the invention in conjunction with the drawing on the hand of an example of construction.

Represented are:

FIG. 1. A top view of a prior art bottle table with central axle, portrayed in basic principle.

Figure 2:
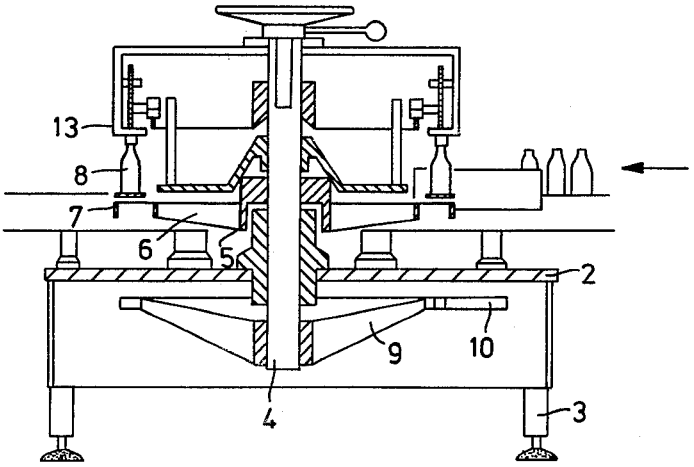
FIG. 2 PRIOR ART

FIG. 2. A side view of the prior art configuration as in FIG. 1.

Figure 3:
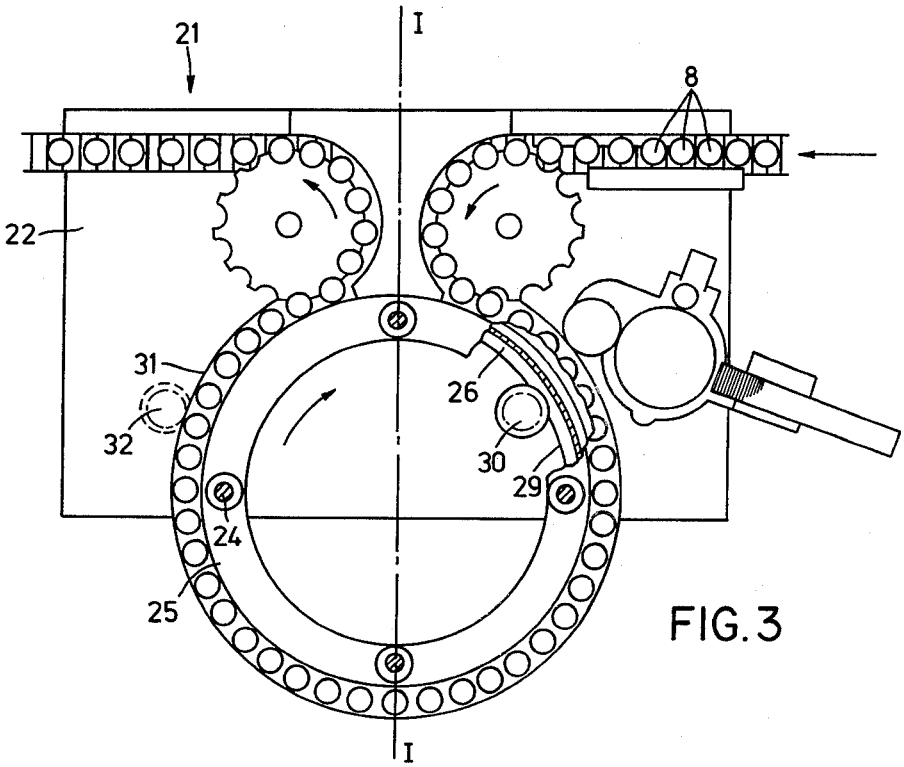

FIG. 3. A top view of a bottle table in keeping with the invention without central axle, portrayed in basic principle.

Figure 4:
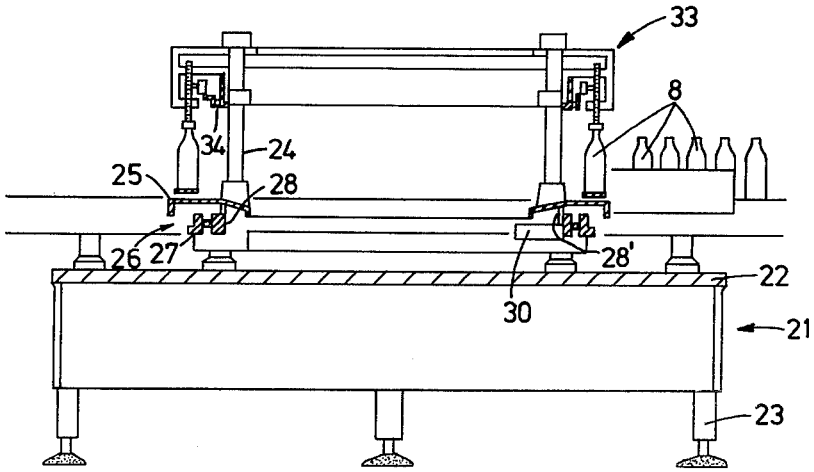

FIG. 4 A side view of the configuration as in FIG. 3, partly in section, and

Figure 5:
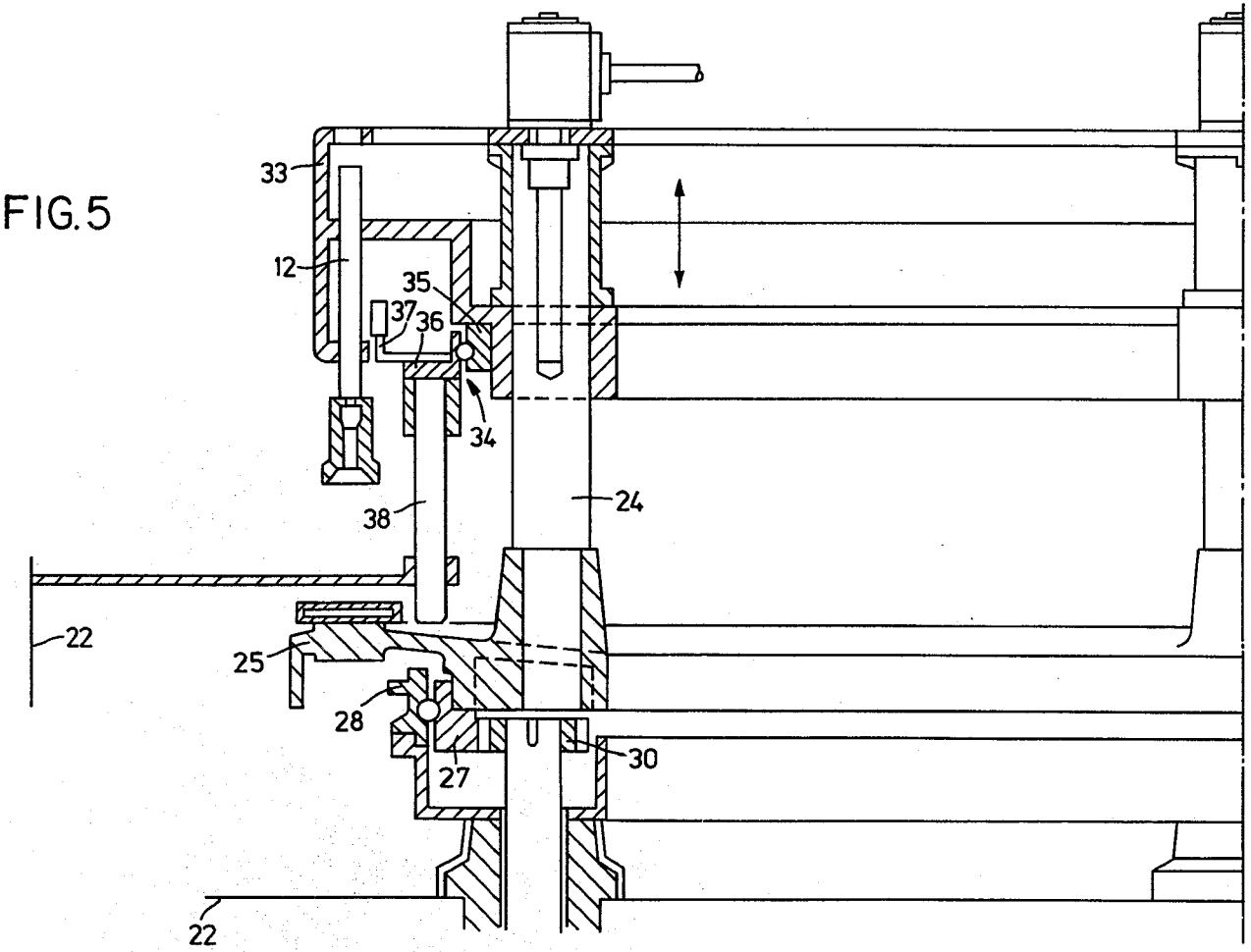

FIG. 5. A detailed sectional presentation of the bottle table and centering head as in FIG. 4.

A bottle labeling machine 1 (FIGS. 1 and 2) with an undercarriage 2 on supports 3. A central axle 4 supported by the undercarriage 2 accepts a hub 5 in which arms 6, forming a star or running radially outward are incorporated, which support, at their extreme ends, a bottle ring 7, on which in peripheral direction bottles 8 are accepted in circular order and transported one after the other. The ring 7 is by means of the central axle 4 furnished with a drive connection 9, which is by preference a gear tooth system and meshes with one or more drive gears 10, e.g. drive pinions. The bottles 8 are transferred to the bottle ring 7 by means of a bottle feed system 11, e.g. an infeed star and are carried from the bottle ring by means of a discharge star 12. A bottle centering system which can be adjusted in height is mounted over the bottle ring 7 and is ring shaped, so that it exerts downward pressure on the bottles positioned on the bottle ring 7, so that the bottle table respectively the rotary plates of the bottle table are positioned and clamped faultlessly. There is a label transfer system 14 on the undercarriage 2, which is arranged in conjunction with the bottle table, so that it applies labels to the bottles, positioned on the bottle ring. This is a known configuration of a bottle table.

Such a known bottle table is, in keeping with the invention, further designed as portrayed in FIGS. 3, 4 and 5. The bottle labeling machine 21 shows in this case an undercarriage 22, which stands on pedestals 23. As an example, on the bottle table 25, four supports are mounted at 90° spacings in peripheral direction. The table 25 is designed with a rotary junction 26 in the form of a ring ball bearing, of which the inner ring 27 can be rotated. This table 25 accepts the bottles. The stationary part of the outer ring 28 of the table 25 forms the rotary junction. The weight of the bottle table 25 as well as that of the bottles 8, which are positioned on the bottle table 25 is carried via the supports 28' by the undercarriage 22. The drive of the bottle table 25 occurs by means of a drive 30 that meshes with the inner perimeter 29 of the bottle table 25 or selectively via a drive 32 that meshes with the outer perimeter 31. Functionally the drive 30 or 32 is a drive pinion which mates with the teeth on the perimeter 29 or 31 of the bottle table 25. Instead of such a tooth system drive another kind of slip-free drive can be used. The bottle guide system, which is not the subject of the invention, is designed similar to that of the known system as in FIGS. 1 and 2.

The undercarriage 22 occupies as per the top view in FIG. 3 somewhat more than half the basal plane of the bottle table 25, so that the remaining portion of the bottle table 25 protrudes from the undercarriage 22 as self-supporting, correspondingly three supports 28' are mounted on the bottle table 25 under the supports 24. The supports can also be mounted farther towards the middle of the undercarriage so that more than half of the bottle table is self-supporting. Consequently the access to the inner area of the bottle table is further improved.

The centering head 33 has a stationary mounting on the bottle table 25 via supports 24 and rotates with the bottle table 25. To raise the centering devices in the transfer area of bottle infeed and discharge, a stationary cam is necessary. A rotary junction 34 is provided for this purpose, whereby the outer ring 36 is held onto the undercarriage by a support 38 while the inner ring 35 rotates. The outer ring 36 accommodates simultaneously the brushing-on components or press-on rollers, by means of which the brushing-on, respectively pressing-on of the labels to the bottles is achieved.

I claim:

1. An assembly for receiving containers to be labeled and for moving the same in sequence between the stations of a labeling apparatus, said assembly including an annular table for supporting said containers, ring bearing means surrounding said table for supporting the same for rotation about a generally vertical axis, an annular container receiving means disposed on the table concentric with the rotational axis for receiving the containers and for supporting the same vertically as said table is rotated, annular drive means disposed on said table concentrically with the axis of rotation, and second drive means disposed within the annulus of said table for engaging said annular drive means for rotating said table about said axis.

2. The assembly set forth in claim 1 wherein said annular drive means includes ring gear means disposed on said table and said second drive means includes pinion means.

3. The apparatus set forth in claim 2 wherein said table is generally ring shaped, said ring gear means is disposed on the inner periphery of said table, said ring bearing means engaging the outer periphery of said table.

4. The apparatus set forth in claims 1 or 2 and including a centering head, adjustable support means supporting said centering head on said table, stationary means surrounding said centering head, said centering head being rotatably supported on said stationary means.

5. The apparatus set forth in claim 4 and including undercarriage means, said stationary means and said adjustable support means being mounted on said undercarriage means, said adjustable support means including lifting cam means.

6. The assembly set forth in claim 4 and including ring bearing means supporting said centering head on said stationary means.

7. The assembly set forth in claim 6 wherein the under carriage occupies less than the basal plane of the table, said stationary means being mounted over a radial range of less than 180° between the table and the undercarriage, the remaining portion of the table being self-supporting.

8. The apparatus set forth in claim 1 and including undercarriage means, said ring bearing means being mounted on said undercarriage means, said undercarriage occupying less than the basal plane of the table, said ring bearing means being supported over a radial range of less than 180° between the table and the undercarriage, the remaining portion of the table being self-supporting.

* * * * *